United States Patent [19]

Low

[11] Patent Number: 4,958,547

[45] Date of Patent: Sep. 25, 1990

[54] WORK ACTIVATED SMALL BREAD SLICING MACHINE

[76] Inventor: George J. Low, 300 Plum Space 91, Capitola, Calif. 95010

[21] Appl. No.: 298,960

[22] Filed: Jan. 19, 1989

[51] Int. Cl.[5] ..... B26D 3/30

[52] U.S. Cl. ..... 83/873; 83/365; 83/370; 83/932; 83/DIG. 1

[58] Field of Search ..... 83/873, 874, 872, 870, 83/DIG. 1, 365, 370, 372, 666, 165, 286, 932; 192/129 A, 135, 137; 100/53

[56] References Cited

U.S. PATENT DOCUMENTS

| | | | |
|---|---|---|---|
| 559,780 | 5/1896 | Landon | 83/666 |
| 1,879,796 | 9/1932 | Ehrlich | 83/872 |
| 1,903,238 | 3/1933 | Larson | 83/872 |
| 2,235,546 | 3/1941 | Ahrndt | 83/872 |
| 3,143,908 | 8/1964 | Schildt et al. | 83/365 X |
| 4,070,941 | 1/1978 | Lorenz | 83/DIG. 1 |
| 4,100,830 | 7/1978 | Lakatos | 83/372 X |
| 4,108,034 | 8/1978 | Thomas | 83/372 X |
| 4,220,065 | 9/1980 | Stanford | 83/873 |

*Primary Examiner*—Frank T. Yost
*Assistant Examiner*—Rinaldi Rada

[57] ABSTRACT

Work activated slicing machine for small edible bread substance such as bagels, buns, and rolls. Incorporated in one housing is a stationary gravity work feeding chute, work sensor at the top of the chute, and carring handle. Within the housing are two DC gear motors driving two rotary knives in the chute. A bread product placed in the top of the chute being allowed to slide toward the two rotary knives, thus breaking the sensor beam, energizing the two rotary knives and pulling the bread product through and out the front, after the product clears the machine the rotary knives stop rotating.

5 Claims, 3 Drawing Sheets

WORK ACTIVATED SMALL BREAD SLICING MACHINE

BACKGROUND OF INVENTION

This invention relates to a device for slicing and pertains particularly to a slicing device for slicing edible substance, more specifically the invention relates to slicing mahcines of the rotary knife type.

DESCRIPTION OF THE PRIOR ART

The following is the patent which the applicant was aware of at the time this application was prepared. An example of prior slicing machine shown is in U.S. Pat. No. 2,235,546 by Ahrndt. In this patent the machine incorporates a single high speed rotary knife, with a adjustable chute to accommodate different product diameter sizes. Its primary use is for slicing of large quantity of bread products.

SUMMARY OF THE INVENTION

The device I have invented allows for single or multiple slicing of edible substance such as bagels, buns, and rolls of various sizes for sandwich marking. The device incorporates within one housing a stationary work feeding chute, carrying handle, and knife cowling for the rotary knives with an embedded metal strip interlock. Work sensors are placed at the top, and inside of the chute. Two gear motors are mounted side by side to the underside and front of the chute. Motor drive shafts protrude upward into the chute. The drive shafts rotate in opposite directions inward and down the chute. The gear boxes transfer driving torque through roller clutches to the rotary knife drive shafts. Roller clutches allow for driving torque of the shafts in one direction and free overrun in the opposite. Two rotary knives are affixed to the drive shafts, held in place by a slotted key ways. The height of a slice is set by adding or subtracting spacers between the chute base and rotary knives. By interrupting a sensor beam in the top of the chute, a circuit is activated that turns on the two motors, and after a preset time the circuit turns the motors off.

OBJECT OF THE INVENTION

An important object of the invention is to provide a machine for safe slicing of single and multiple small breads such as bagels, buns and rolls of various sizes for sandwich making.

Further object of the invention is to provide a machine that will automatically slice small breads, such that a worker need not manually turn the machine on or off for each bread sliced.

Still further object of the invention is to provide a slicing machine that will slice mixed diameter small breads without needing adjustment.

DESCRIPTION OF THE PREFERRED EMBODIMENT

Figure 1:
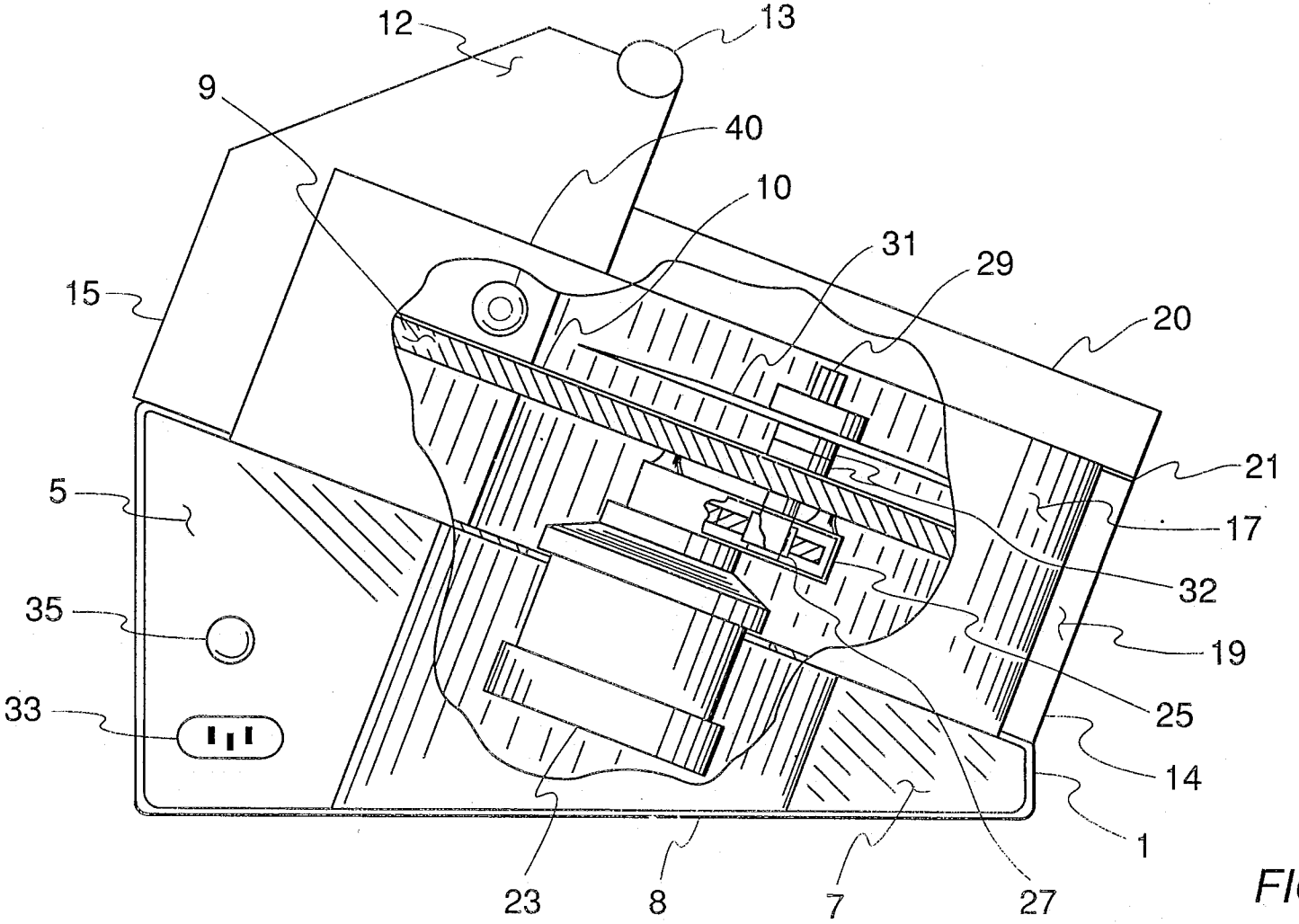

The invention will be best understood from a consideration of the following detailed description taken in connection with the accompanying drawing forming part of this specification. With the understanding, however, that the invention is not confined to any strict conformity with the showing of the drawing but may be changed or modified so long as such changes or modifications make no material departure from the salient features of the invention as expressed in the appended claims.

FIG. 1. is the left side view.

Figure 2:
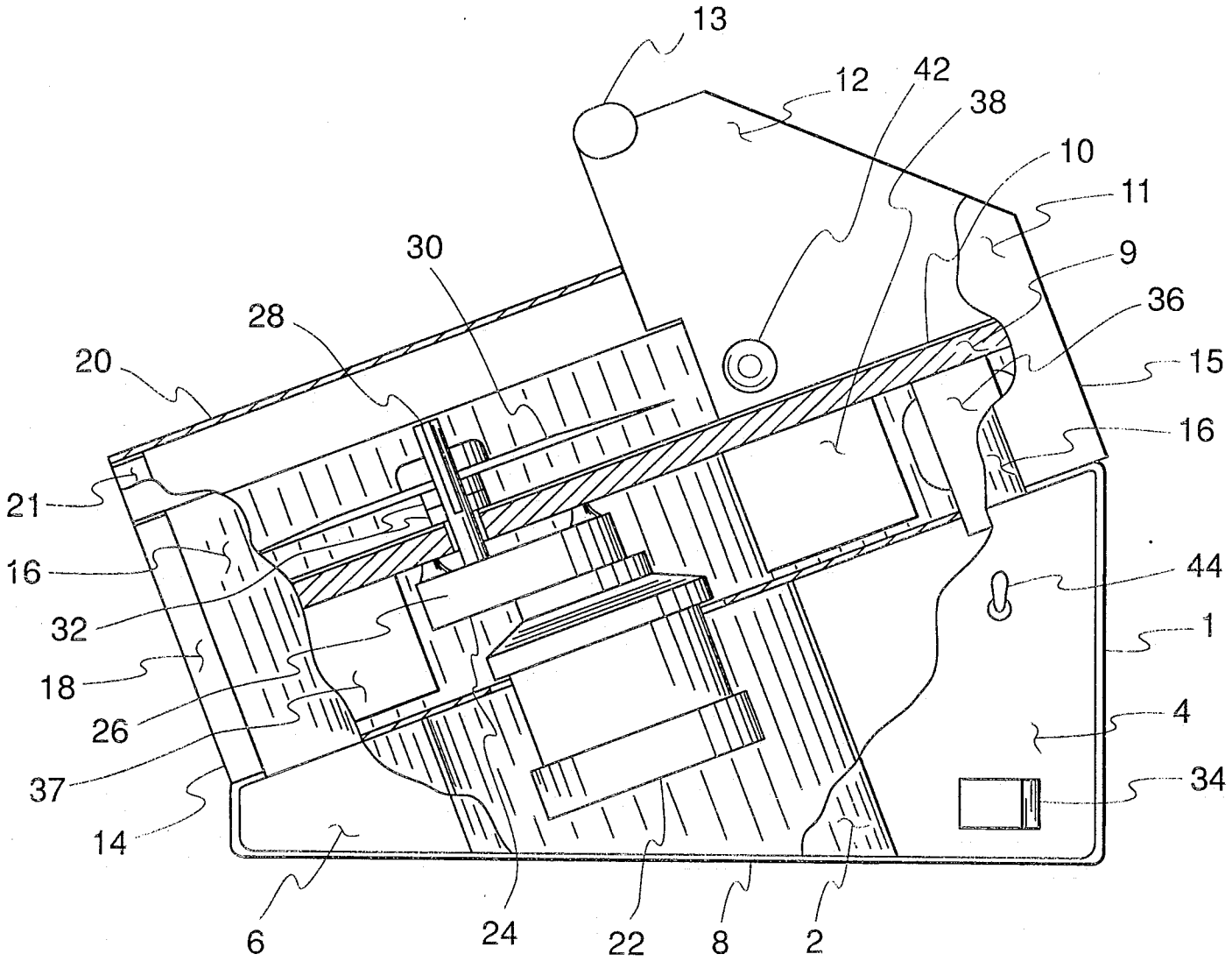

FIG. 2. is the right side view.

Figure 3:
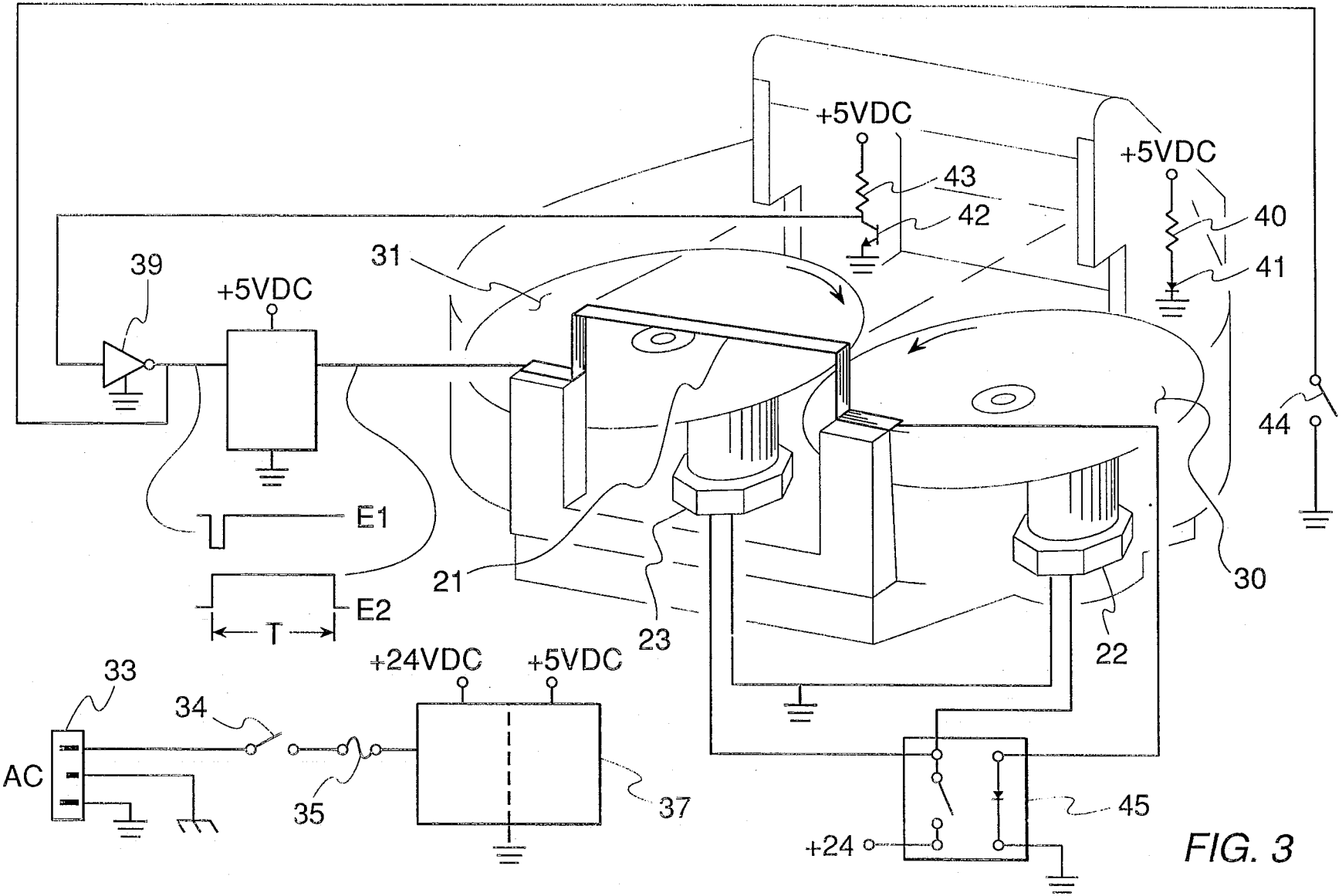

FIG. 3. is the electrical schematic.

Referring to the drawings shows the embodiment of the invention.

In the right side views FIGS. 1 and 2, the slicing machine shown comprises an inclined base wedge 1 of which the angle being optimally set to allow for gravity feeding work into the rotary knives 30 and 31 the base wedge 1 is enclosed by, right rear side cover 4 left rear side cover 5 right front side cover 6 left front side cover 7 right side motor bulge 2 and left side motor bulge 3 allowing for motor shape. Completing the wedge enclosure is an access lid 8 at the base of the wedge. Standoff 14 is mounted at the front of the wedge, while standoff 15 is mounted at the rear. On these standoffs are mounted the chute base 9 covered by a metal skid plate 10. At the rear, upper end of chute base 9 are placed the right side wall 11 and left side wall 12. The carrying handle 13 ties the upper portion of the side walls 11 and 12 together, completing the upper portion of the chute. At the front, lower end of the chute base 9 are placed the right cowling post 18, and left cowling post 19. Rotary knife shields 16 and 17 are affixed to lower circular protrusions of chute base 9. The opening formed by the right shield 16 and left 17 shield with raised clearance between side cowling post 18 and 19 form the knife cowling 20. Embedded in the front portion of the knife cowling post 18 to the right knife cowling post 19 is a metal strip forming the cowling interlock 21. Work sensors consisting of receiver 42 mounted in right side wall 11, and transmitter 40 mounted to the left side wall 12 are stationed opposite each other and at the top and inside of the chute. Right motor 22 are attached to gear box 24 and left motor 23 are attached to gear box 25, both are mounted opposite each other and to the underside of chute base 9, there drive shafts 28 and 29 protrude upward into chute base 9. Drive shafts 28 and 29 are driven by gear boxes 24 and 25. Incorporated within the gear boxes are left roller clutch 26 (hidden, FIG. 2) and right roller clutch 27 (shown, FIG. 1). The roller clutches allow for torque in one direction and overrunning in the opposite. The right rotary knife 30 is affixed to the right drive shaft 28 while the left knife 31 is affixed to the left drive shaft 29. The rotary knives assemblies are locked in place by slotted key ways. The height of the rotary knives 30 and 31 are set above the chute base 9 by spacers 32.

In the electrical schematic FIG. 3. AC line power is brought into the machine through power cord plug 33 then to power switch 34 then to safety fuse 35 and into power supply 37. The output of power supply 37 provides twenty four (24) volts DC for motors 22 and 23, and five (5) Volts DC for the control logic 38. Infrared emitting diode 41 with current limiting resistor 40 comprise the sensor transmitter. Energy from this diode 41 is transmitted across the top part of the chute base 9, and into phototransistor 42. Phototransistor 42 with curent limiting resistor 43 comprise the sensor receiver. Output of the phototransistor 42 is at a low potential when the infrared energy is sensed. When the energy into phototransistor 42 is blocked by a bread item its output is at a high potential. This output of the phototransistor is fed into the inverter 39, inverting the potential. The output is then fed into the retriggerable monostable delay circuit 38. A negative going pulse E1 is needed to trigger the delay circuit 38. In addition a jogging switch 44 is also fed into the input of the delay circuit. Toggling the jogging switch 44 sets the input of the delay circuit to a low potential. When the input pulse E1 goes negative the output of the delay circuit 38 goes positive E2. The length of the output pulse E2 is set by an RC time constant in the delay circuit 38. The output of the delay circuit 38 is then threaded through the front of knife cowling 20 by way of the cowling interlock 21, then to the control input of relay 45, activating the two motors 22 and 23. Motor 22 rotates CCW while motor 23 rotates CW.

OPERATION OF THE SLICER

Turning main power switch 34 ON will ready machine for operation, but rotary knives 30 and 31 will not rotate. To test the machine for operation, toggle the jogging switch 44, this will cause the rotary knives 30 and 31 to rotate. To slice a small bread, place it on top of chute and allow it to slide toward the rotary knives, past the sensor beam, this will energize the rotary knives 30 and 31 and pull the bread through. The product will exit the front of machine sliced. After a preset time, the rotary knives 30 and 31 will stop rotating.

CLEANING AND ADJUSTING HEIGHT OF KNIVES

For cleaning or adjusting of the rotary knives 30 and 31, remove rotary knife cowling 20. The removal of the cowling 20 will break the electrical circuit to the relay 45, preventing the knives 30 and 31 from rotating. It is now safe to remove the knives 30 and 31. Lifting the knives 30 and 31 will expose the spacers 32 under each knife. By adding or subtracting spacers 32 from under the rotary knives the height from the base of the chute can be adjusted thereby adjusting heighth of slice. Replace knives 30 and 31 the opposite of removal. Replacing knife cowling 20 will complete the circuit to relay 45 allowing for knives 30 and 31 to rotate.

While the above description contains many specifications, these should not be construed as limitations of the invention, but rather as an exemplification of one preferred embodiment thereof. Many other variations are possible, for example:

1. Steel or plastics can be used in its construction. Accordingly, the scope of the invention should be determined not by the embodiment illustrated, but by the appended claims and their legal equivalents.

I claim as my invention:

1. A device for slicing single and multiple small bread items such as bagels, buns, and rolls, comprising:

a housing;

an inclined chute having a sliding surface for guiding said bread items;

first and second rotary knives defining a cutting plane substantially parallel to the sliding surface;

first and second knife motors for actuating said knives;

first and second walls located at an upper end of said chute, each of said walls mounted on opposed sides of said chute;

first and second knife shields located at the lower end of said chute adjacent said knives, each of said shields mounted on one of said opposed sides of said chute;

first and second cowling posts mounted adjacent each of said shields;

a knife cowling mounted on both said cowling posts, wherein the knives are located between the knife cowling and sliding surface;

an electrical control circuit for the activation of said motors, the control circuit comprising a work sensing transmitter mounted on one of said walls and a work sensing receiver mounted on the other of said walls, said transmitter and receiver configured to sense the presence of said small bread item on the chute and to activate the motors when said bread item is sensed;

the control circuit further comprising a metal strip mounted on said cowling and forming a cowling interlock with said posts, said cowling interlock providing an electrical continuity between said posts so as to permit activation of said motors and for preventing the activation of said motors when said cowling is removed from said device.

2. The device of claim 1, wherein the control circuit further comprising a delay circuit for deactivating the motors at a predetermined time after the activation of the motors.

3. The device of claim 1, further comprising a carrying handle mounted between said walls.

4. The device of claim 1, further comprising a metal skid plate cover forming the sliding surface of said chute.

5. The device of claim 1, further comprising spacers mounted on said motors for setting the cutting plane at a predetermined distance from said sliding surface.

* * * * *